United States Patent [19]

Custer

[11] Patent Number: 4,535,955

[45] Date of Patent: Aug. 20, 1985

[54] MEANS FOR SENSING AN UNDESIRABLE APPROACH ANGLE IN A LEVEL WIND COILER

[75] Inventor: Donald J. Custer, Akron, Ohio

[73] Assignee: Morgan Construction Company, Worcester, Mass.

[21] Appl. No.: 480,654

[22] Filed: Mar. 31, 1983

[51] Int. Cl.[3] ..... B65H 54/28

[52] U.S. Cl. ..... 242/158 R; 242/25 R

[58] Field of Search ..... 242/158 R, 158 B, 158 F, 242/158.2, 158.4 R, 25 R

[56] References Cited

U.S. PATENT DOCUMENTS

| | | | |
|---|---|---|---|
| 2,845,229 | 7/1958 | Bliss | 242/25 R |
| 2,988,292 | 6/1961 | Bliss | 242/158.4 R X |
| 3,031,153 | 4/1962 | Attwood et al. | 242/158 R |
| 3,039,707 | 6/1962 | Beck et al. | 242/158.2 X |
| 3,319,070 | 5/1967 | Schneider | 242/158 R X |
| 3,441,235 | 4/1969 | Sperduti | 242/158.4 R |
| 3,507,458 | 4/1970 | Merchant et al. | 242/158.4 R |
| 3,544,035 | 12/1970 | Woolever | 242/158 R |
| 3,815,846 | 6/1974 | Biewer | 242/158 R |
| 3,833,184 | 9/1974 | Hara et al. | 242/158 R |
| 4,022,391 | 5/1977 | Stein et al. | 242/158.4 R X |
| 4,410,147 | 10/1983 | Seibert | 242/158 R |

*Primary Examiner*—Stanley N. Gilreath

*Attorney, Agent, or Firm*—Maurice E. Gauthier

[57] ABSTRACT

A level winding apparatus for coiling elongated material, such as wire or tube, into a compact coil. A non-contacting device located near a spooling arrangement for coiling consists of at least two parallel spaced-apart arm arrangements each located on either side of the material as it is wound onto a spool. Each arm arrangement is adjustable to accommodate the transverse dimension of the material and carries a photoelectric control unit having fiber optic carrying cables connected to transmitter and receiver means for creating a high intensity light field extending at least a length to accommodate a range of paths of travel the material takes from the feeding means to the spool starting from an empty spool to build-up of the coil. An undesirable approach angle of the material onto the spool is detected and a correction is made so that the formed coil contains a number of superimposed layers each with a number of evenly and closely abutting adjacent windings.

4 Claims, 4 Drawing Figures

MEANS FOR SENSING AN UNDESIRABLE APPROACH ANGLE IN A LEVEL WIND COILER

FIELD OF THE INVENTION

Background

The invention relates to a coiling system for coiling elongated material, such as tube, wire, or cable, into compact coils on a spooling arrangement. In particular, a non-contacting means and a method thereof is used to set up a high intensity sensitive field to sense any undesirable lag or lead approach angles of the material, and to cause a modification thereof so the convolutions of the material are placed evenly and tightly on the spool.

Prior Art

In a coiling system, there are several conventional apparatuses used for coiling or spooling elongated material in a manner to place the windings or convolutions on the spool tightly and closely abutting each other to form evenly superimposed layers. The types of apparatuses used and the method for performing the take-up or coiling of the material affects the quality of the packaging of the material.

For the coiling process, there are generally two types of spoolers. The first type involves a rotation of the spool, while an external device directly contacting the material, moves traversely across the spool to lay the material in place on the spool. In the second type of take-up arrangement, and which has become generically referred to in the industry as a "level wind coiler", the spool is traversed while the path of the material is fixed. In both types of spoolers, any traverse lead and/or lag angle is measured so that a corrective movement of either the material or the spool can be made.

Some of the first type of spoolers may be disclosed in U.S. Pat. Nos. 2,845,229 and 2,988,292, which generally detect a lag angle. An example of the second type of spooler which teaches a detection of a lag or lead angle is disclosed in U.S. Pat. No. 4,022,391. The measuring of the traverse approach angle of the material onto the spool is done either by a material contacting mechanical arm connected to some type of mechanical-electrical signalling device, or through the use of a device employing a photoelectric cell. A disadvantage of the two former U.S. patents is that a lag angle is basically detected, which is not sufficient for an optimization of a perfectly formed coil.

In some other designs for a level wind type of coiler, a mechanical arm is used to touch and ride on the material approaching the spool or on the spool in order to detect the approach angle needed to press the next winding evenly against the previously placed winding. This type of design invariably results in the marking of the material, and at times, the arm jumps off of the material resulting in a complete loss of control of the coiling system, thus, requiring constant operator supervision, and this can result in lower production speeds, low quality material packaging, and high volume of scrap material.

In some of the above mentioned designs where a single photoelectric relay cell is used, it is necessary to locate the cell close to the material's travel where it is subject to adherring contaminates generated through continuous use of the coiling system. The adherring of the contaminates on the cell's window also contributes to the ineffiencies of the system, with the possible outcome being that the windings are loose, spacedapart, tangled, or placed on top each other. Also, these photoelectric cells inherently were not repeatable i.e. not accurate enough to sense the material at the same place each time.

SUMMARY OF THE INVENTION

The present invention has been devised in order to overcome the drawbacks of the above mentioned systems. It is an object of the subject invention to provide a means for automatically and more effectively forming compact coils.

It is a further object of the present invention to provide a coiling system which can be operated with little or no operator supervision in which productivity is optimized, material packaging quality is increased, and the volume of scrap is decreased.

It is a still further object of the present invention to provide a coiling system which produces evenly and tightly placed convolutions in a row onto a spool and to lay each winding of a superimposed layer between two windings of the most recently formed layer.

And yet a still further object of the present invention is to provide a material non-contacting sensing means in a coiling system which produces at least two high intensity sensitive fields between which material travels prior to its being wound onto a spooling arrangement. The fields sense if and whether the speed of the material leads or lags the axial speed of a traversing mechanism, which causes the windings to be positioned between the flanges of a spool.

More particularly, an object of the present invention is to provide a coiling system for coiling elongated material, such as tube or wire, exiting from a feeding means thereby creating a range of paths of travel defined by the minimum and maximum coil diameters, comprising: a rotatable spooling arrangement consisting of a spool for receiving and forming said material into a coil having a number of equally placed strand windings in a row and a number of compact layers of said row in which the lead in material of a strand being wound onto said spool forms a tangential area immediate to said spool and which strand may be subject to variations in its approach angle from said feeding means to said spool due to the operational characteristics of said coiling system, means for varying the movement of said strand of material axially of said spool and varying the speed of rotation of said spool, sensitive means for projecting at least two spaced-apart high intensity fields a desirable length for sensing any deviation of said material upon its path of travel which would result in an unequal spacing of said windings in said row, means for mounting said sensitive means constructed and arranged in a manner that said two sensitive fields are each located on opposite transverse sides of said material coincidental to each other and, range of paths of travel spaced above but close to said tangential area, each said sensitive means includes means for representing a change in its respective intensity field, said change caused by said deviation of said material from said path range and its entry into said respective intensity field, control means for receiving said representation and equating said representation to an actual approach angle, including means associated with said means for moving said strand material for effecting a corrective movement of said strand material to change said actual angle into a desirable angle so that each said material strand is placed onto said spool to form said evenly placed windings, and a method thereof.

These objects as well as other novel features and advantages of the present invention, will become more apparent and better appreciated when the following description of a preferred embodiment is read along with the accompanying drawings.

DETAILED DESCRIPTION

A preferred embodiment of the present invention, pertains to a design for a traverse angle measuring mechanism for accurately positioning each strand so that an appropriate winding is placed and formed on the spool. It is used in conjunction with a level wind coiler, previously defined to mean that the spindle or spool traverses axially while the other components of the coiling system are fixed. The preferred embodiment will be explained in terms of coiling tubing wherein it is extremely important to maintain its ovality throughout the coiling operation, and which is achieved by the subject invention. The principles and operation of a coiling system in which the subject invention has particular application is disclosed in any of the above referred to U.S. Patents and therefore, only the features and operation of the present invention will be fully explained.

Figure 1:
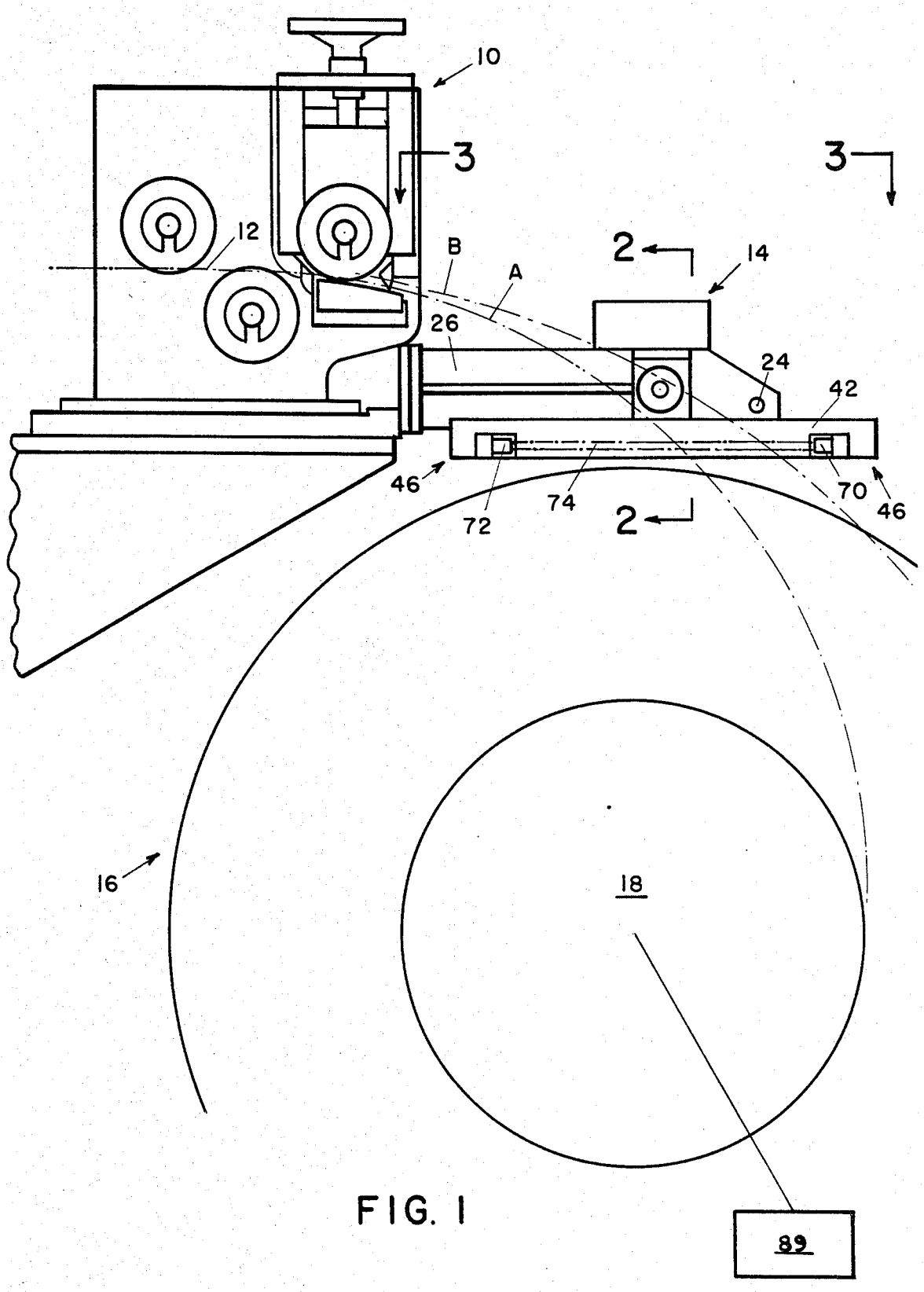
FIG. 1 is an elevational, schematic view illustrating the environment of the present invention.

With reference first to FIG. 1, there are three components of a coiling system in a level wind coiler line which are: a casting unit 10, for forming an arc or bend in the tubing 12 for easy spooling; a non-contacting sensing apparatus 14 for sensing an approach angle, and more about which will be explained later; and a spooling arrangement 16. As can be seen, approach angle sensing apparatus 14 is stationarily mounted to casting unit 10, and is located above in proximity to spooling arrangement 16. The design of apparatus 14 enables it to be placed as closely as possible to the nip or tangential area formed by the lead tubing 12 of a strand being wound onto spooling arrangement 16. This is important so that a more accurate approach angle can be measured.

After a strand of tubing 12 is cast, it travels downwardly onto and around a spool 18. Tubing 12 being wound on an empty spool is represented by phantom arc A, and tubing 12 approaching its built-up or desired maximum diameter is indicated by phantom arc B.

As stated earlier, a purpose of the present invention is to provide a means and method for representing and correcting any deviations from the tubing's range of paths of travel spanning a minimum to a maximum diameter formed coil, which deviation would result in any number of conditions for the windings, one of which is an unequal spacing of the convolutions or windings on the spool. The "approach angle" or "attitude angle" is better defined in the above referred to U.S. Pat. No. 4,022,391.

The subject invention will now be described with reference to all FIGS. 1, 2, 3, and 4, wherein similar components are given the same reference numerals.

Angle detecting apparatus 14 consists of two cantilevered, parallelly spaced-apart arm arrangements 20 and 22. Only one complete arm arrangement 20 is shown in the FIGS. 2 and 3, but it is to be understood that arm arrangement 22 is similar in design and operation to that of arrangement 20 fully shown. As best shown in these FIGS. 2 and 3, these arrangements 20 and 22 are positioned along the longitudinal path tubing 12 takes upon its exit from unit 10 downwardly onto spool 18, and are rigidly tied together through rod 24 underneath which tubing 12 travels. This rod 24 acts as a safety guard in the event tubing 12 breaks and generates a long tail, which, if no guard existed, may spring up causing injury to the operator.

Figure 3:
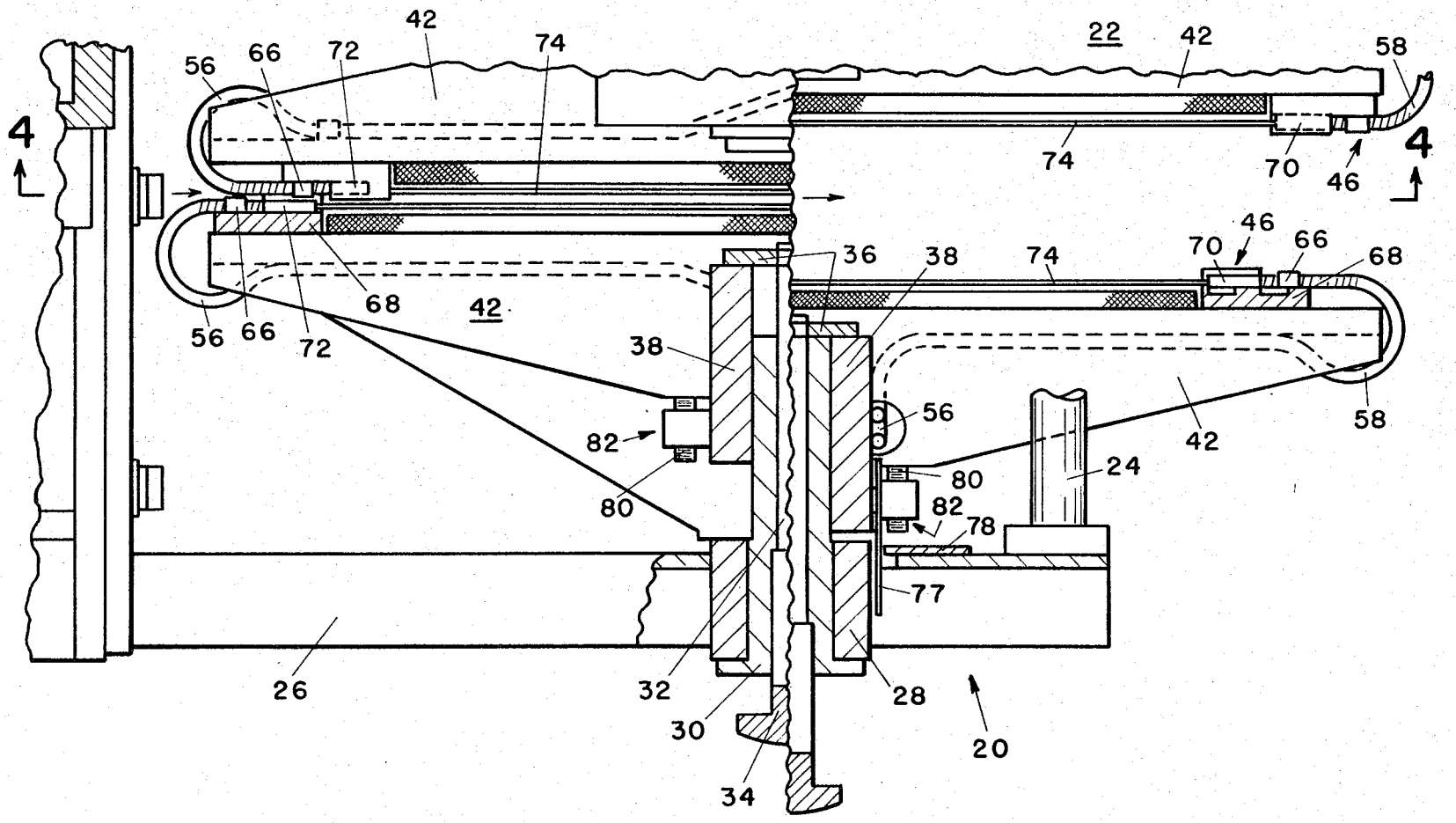
FIG. 3 is a partial, sectional view taken along lines 3—3 of FIG. 1, illustrating the present invention in two traverse positions relative to the material's travel.

Arm arrangements 20, 22 can be brought close together leaving a gap approximately the size of the smallest tubing and as far apart to create a gap for the largest size tube. The arrangements 20, 22 to the left of FIG. 3 are shown in a maintenance positioning for the arms 20, 22 which gap would be larger than the maximum size tubing. The center line of the path of travel of the tubing between arms 20, 22 is shown by the arrow in FIG. 3.

Figure 4:
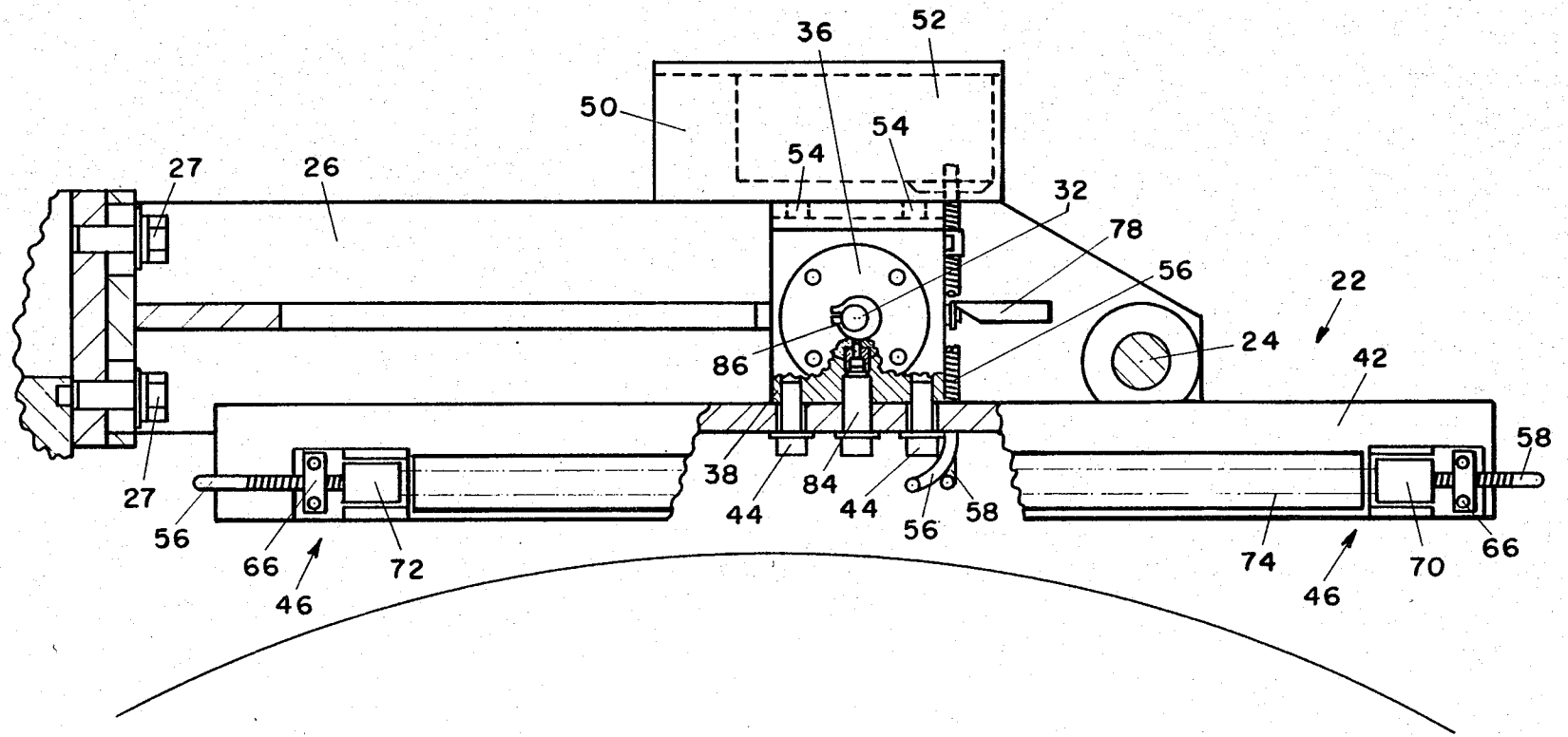
FIG. 4 is an elevational, partly broken away view taken along lines 4—4 of FIG. 3.

For the cantilever mounting of each arm arrangement 20 and 22, a "C" shaped housing bracket 26 is fixed to forming unit 10 through bolts 27 shown in FIG. 4. Mounted outwardly towards the end of each housing bracket 26 is a two piece sleeve 28 having an internally threaded portion 30 for receiving a threaded rod 32. At an end of rod 32 is a knob handle 34, and fixed to the other end is a bearing retainer plate 36 secured to a sliding sleeve member 38. This sliding sleeve member 38 supports several components comprising moveable assembly 40, best shown in FIGS. 2, 3, and 4. Sliding assembly 40 generally consists of a steel angle plate 42 bolted by bolts 44 to the bottom of sliding sleeve 38 for mounting and positioning sensing means 46, more about which will be discussed shortly.

Mounted through means (not shown) on top of slide sleeve 38 is another steel plate angle 48 welded to another steel angle 50, which, in turn is used to support a photoelectric control unit 52 which generates a high intensity light source. The length of angle 50 is somewhat longer than control unit 52.

Figure 2:
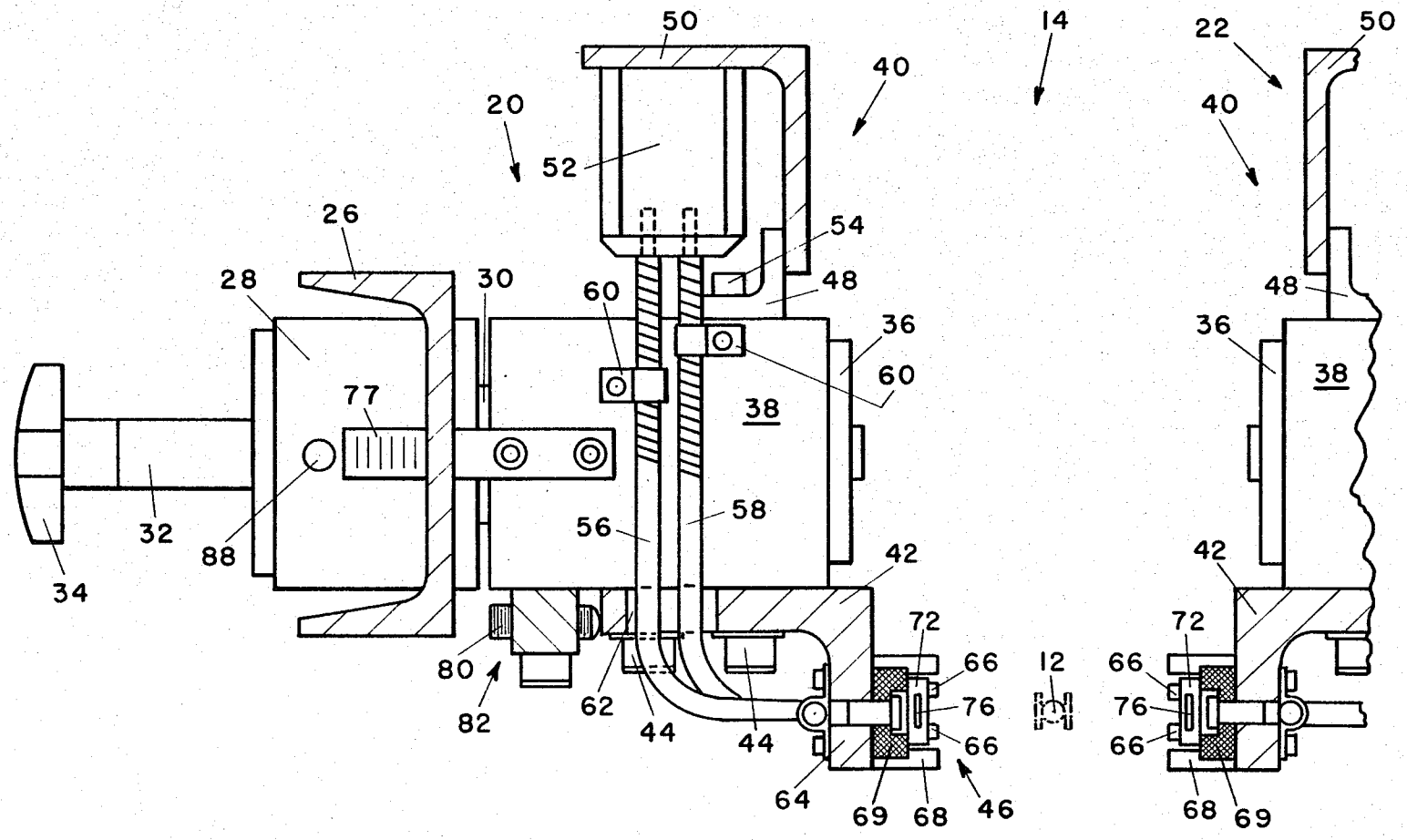
FIG. 2 is a partial sectional view incorporating the features of the present invention and taken along lines 2—2 of FIG. 1.

The supporting of photoelectric control unit 52 from bracket 50 is done through suitable fastening means (not shown). Extending down from control unit 52 are two cables 56, 58 which are part of sensing means 46. These two cables 56, 58 protect and carry fiber optics, which as can be best seen in FIG. 2, commence or terminate in control unit 52. The securing of these cables 56 and 58 to sleeve 38 are done by clips 60. Cables 56, 58 extend down through an opening 62 in angle bracket 42 and separate in opposite directions to extend along and around extreme leg 64 of bracket 42 (FIG. 2).

FIG. 3 illustrates the running of cable 58 to the right and cable 56 to the left in this Figure. These fiber optic cables are secured in position by clip pins 66 and connected to sensing mounting means 68 attached to the inside of bracket 42. Cable 58 is connected to light transmitting unit 70 and cable 56 is connected to light receiving unit 72, which two units 70, 72 are necessary in order to send and receive the high intensity light generated by control unit 52 to create a high intensity modulated light field which is in the infra red range and which field is remotely located from control unit 52 in the area in which tubing 12 travels. This high intensity field created by the cooperative functioning of units 70, 72 is indicated at numeral 74. The longitudinal length of field 74 depends on the relative spacing of transmitting and receiving units 70, 72. Both these units 70 and 72 consist of a window 76 positioned to face each other, and the transverse width and length of this field depends on the dimensions of this window (FIG. 2). Mounting means 68 permit a clearance to be established between the field 74 and bracket 42 for the mounting of a guard 69. This guard 69 is made of a suitable friction free material which furnishes as a fail safe device in the event the photoelectric cell becomes unoperative. Under normal circumstances, tubing 12 does not contact guard 69. However unit 70, 72 can be mounted to bracket 42 without distracting from the essence of the present invention in which case guard 69 would not be used. Also the positioning or mounting of means 70 and 72 can be the reversal of what is disclosed herein.

As mentioned previously, FIG. 3 clearly shows to the right thereof the maximum spacing and to the left thereof the minimum spacing of arm arrangements 20 and 22. Transmitter means 70 to the right and receiver means 72 to the left of FIG. 3 are shown to be slightly off-centered relative to the identical means opposite each other. This allows the arm arrangements to come closer together to create a minimum gap between the fields 74 for sensing the minimum diameter tubing. The exact spacing of these arm arrangements 20, 22 can be indicated by scale plate 77 and plate 78 bolted to bracket 26 shown best in FIG. 2. Scale plate 77 is mounted to sleeve 38 and overlaps sleeve 28. Its markings are in either inches or centimeters or both. Plate 78 mounted perpendicularly to the inside of bracket 26 is set alongside scale plate 77 for easy alignment of the respective arm arrangement 20, 22 by a reading of the scale markings.

Camber adjustment of the entire slidable assembly 40 can be made by loosening bolts 44 and repositioning screws 80 in screw and bracket assembly 82 mounted to the bottom of sliding sleeve 38. In FIG. 4, a pin 84 extends into sleeve 38 to keep arm arrangement 20, 22 in registry with the member 26 throughout the cambering process, after which time the bolts 44 are tightened. Spring clip 86 holds threaded shaft 32 in place in member 30. The positioning of slideable assembly 40 is secured through the threads of rod 32 and member 30, but this positioning can be assured through suitable locking means (not shown) in an opening 88.

A length of field 74 relative to the diameter of spooling arrangement 16 is generally shown in FIG. 1. This length is such that it spans the tubing's range of paths of travel, which range extends substantially equally on both sides of an imaginery vertical axis through the spooling arrangement 16 of FIG. 1. For example, if tubing 12 should make an arc falling near the unit 72 and if it deviates from its desirable path sensitive fields 74 would continue to sense the deviation.

Sensing means 46, as mentioned above, consists of the light transmitter means 70 and the light receiving means 72 for creating the sensitive field and fiber optic cables 56 and 58 for carrying the light to transmitter means 70 and away from receiver means 72 back to photoelectric control means 52. Depending upon the tubing's travel in this field and the type of photoelectric control used, the concentration or intensity of light will vary or will be broken altogether. In this preferred embodiment, the photoelectric control used will be of the type wherein field 74 is broken. This statement will become clearer in the following explanation of the operation of the subject invention during the coiling process;

A coil of tubing from a tube drawing machine is to be coiled for manufacturers' use in a level wind coiler line. The tube is paid off an initial coil, and brought through several units which clean, straighten, test, paint, mark, and cast the tube prior to its being wound onto a spool.

The construction of spooling arrangement 16 and the electrical circuitry for the control of the coiling process will follow any of the coiling systems of the prior art addressed to the traversing of the spool. The rate of the traverse speed of the spool depends upon the diameter of the tubing, the speed of the material travel, and the built-up diameter of the coil being formed. Due to these operational factors, the speed of the tubing exiting from forming unit 10 may cause the tubing 12 to either lag or lead the axial movement of the spool 18.

If no speed difference exists, the subject invention will not be operated since the tubing is following a desirable path; i.e. the approach angle may approach zero degrees. If, however, the speed of the tubing and the axial speed of the spool differ, then the tubing will be caused to be pulled to the left or to the right of this desirable path, thus resulting in an unacceptable tubing approach angle. This is when the subject invention will come into operation.

Prior to the coiling process, arm arrangements 20 and 22, and therefore, the two high intensity fields are positioned relative to each other to accomodate the diameter tubing being coiled. This positioning is done through rotation of rod 32 affecting movement of sliding assembly 40. The operator can check the scale 77 and indicator 78 for a verification of this positioning. For the measuring of the approach angle it is mandatory for tubing 12 to be parallel and coincidental to both intensity fields 74 as shown in FIGS. 2 and 3.

In referring to FIG. 2, if tubing 12 veers to the right upon its travel, intensity field 74 of arm arrangement 22 is broken. If tubing 12 veers to the left, intensity field 74 of arrangement 20 is then broken. This interruption of the intensity fields 74 which in effect is a lack of light is sensed by receiver means 72, and the sensing is carried to photoelectric control unit 52 by fiber-optic carrying cables 56. In control unit 52 this sensing is compared with the transmitted intensity in the same control unit, and this difference is transformed into a representation of the actual approach angle tubing 12 is taking. This representation, in the form of an electric signal, is then sent to a main control unit (shown at 89) which modifies the rate of speed of the axial movement of the spool transversely relative to the forming unit 10. Of the photoelectrical control units 52, the one which sends the electrical signal is the determinate factor as to whether the approach angle is a lag or a lead angle relative to the spool's axial movement, and therefore, this electrical signal determines the direction in which spool 18 is to move in order to attain the desirable approach angle. For example, with respect to FIG. 3 if the spool is traversing toward the bottom of this Figure, the light field from the uppermost units 70, 72 is broken, the signal is a lag and the traverse speed will be increased. Conversely, in the same example if in the lower most units 70, 72, the light field is broken, a lead signal results, and the traverse speed is decreased.

Throughout the operation of the coiling process by the use of the subject invention, each winding is pressed evenly and tightly against each other to form a row along the spool from one flange to the other flange until the spool is filled, wherein the next layer is superimposed such that each winding of this superimposed layer is placed between and on top of the two lower adjacent windings of the most recently placed layer. This operation continues until the desired maximum diameter coil is formed. As can be appreciated from FIGS. 1–4 the length of the two intensity fields 74 permits the detection of any undesirable approach angle from the commencement to the termination of the coiling process, which approach angle would interfer with an even placing of the windings. Due to the speed control of the system brought about by the subject invention, the overall quality of the package including the ovality of the tubing on the spool is always retained.

Items 52, 56, 58, 70 and 72 are commodities which are well-known and available in the related industry.

Even though a preferred embodiment of the subject invention encompasses the use of fiber optics connected to a photoelectric control means for the production of a high intensity field, it is to be understood that any frequency modulating means, such as a radio frequency source can be used. In some applications, it may also be feasible to use electromagnetic or sonar proximity devices to produce this high intensity field.

It is to also be understood, that the subject invention will work effectively if arm arrangements 20, 22 are stationarily mounted, while the forming unit 10 moves transversely relative to the fixed spool, or if the arm arrangements 20, 22 are mounted to the spooling arrangement, while forming unit 10 traverses.

In accordance with the provisions of the patent statutes, I have explained the principle and operation of my invention and have illustrated and described what I consider to represent the best embodiment thereof.

I claim:

1. For use in combination with a guide device for directing an elongated strand to a rotating spool on which the strand is wound into a coil consisting of multiple layers of strand windings, with the optimum arrangement of the windings in each layer being dependent upon the strand passing from the guide device to the spool along an unrestrained path defining a selected approach angle with respect to the rotational axis of the spool, a control system for maintaining the strand on said path, said system comprising:

reciprocating means for arranging the windings on said spool by producing relative reciprocal motion between said guide device and said spool;

means for generating a pair of parallel high intensity fields spaced one from the other in the direction of the spool axis, the said fields being located on opposite sides of said path and defining a gap therebetween in which said strand may move to accommodate variations in the diameter of the coil being formed on said spool while allowing the intensities of said fields to remain unaffected;

detector means for detecting changes in the intensities of one or the other of said fields occasioned by the strand straying from said path into said fields, thereby causing a change in said approach angle; and control means responsive to said changes in field intensities for modifying the operation of said reciprocating means to thereby return said strand to said path.

2. The control system of claim 1 further comprising means for adjusting the spacing between said high intensity fields.

3. The system of claim 1 wherein the generating means comprises light transmitters and light receiving means located respectively at opposite ends of each of said high intensity fields.

4. The system of claim 3 wherein said light transmitters and said light receiving means are connected to said detector means via fiber optic cables.

* * * * *